US005693951A

United States Patent [19]

Strong, III

[11] Patent Number: 5,693,951

[45] Date of Patent: Dec. 2, 1997

[54] MISSILE LAUNCH AND FLYOUT SIMULATOR

[75] Inventor: Maurice Leroy Strong, III, Wheeling, Ill.

[73] Assignee: Northrop Grumman Corporation, Los Angeles, Calif.

[21] Appl. No.: 570,036

[22] Filed: Dec. 11, 1995

[51] Int. Cl.[6] ..... H05B 37/02

[52] U.S. Cl. ..... 250/504 R; 273/348.1

[58] Field of Search ..... 250/504 R; 273/348.1

[56] References Cited

U.S. PATENT DOCUMENTS

| | | | |
|---|---|---|---|
| 3,618,096 | 11/1971 | Schomeborn | 343/18 E |
| 3,741,502 | 6/1973 | Schroader et al. | 244/3.13 |
| 4,215,347 | 7/1980 | Jarrell et al. | 343/117 R |
| 4,241,889 | 12/1980 | Schwellinger et al. | 244/315 |
| 4,326,847 | 4/1982 | Roe | 434/12 |
| 4,864,146 | 9/1989 | Hodges et al. | 250/504 R |
| 4,935,881 | 6/1990 | Lowenson et al. | 364/550 |
| 4,969,819 | 11/1990 | James | 434/5 |
| 4,990,920 | 2/1991 | Sanders, Jr. | 342/14 |
| 5,012,250 | 4/1991 | Foley | 342/53 |
| 5,061,930 | 10/1991 | Nathanson et al. | 342/13 |
| 5,160,264 | 11/1992 | Banura et al. | 434/2 |
| 5,224,860 | 7/1993 | Waldman et al. | 434/21 |
| 5,336,894 | 8/1994 | Ellers | 250/504 R |
| 5,341,146 | 8/1994 | Vennum et al. | 342/170 |
| 5,414,347 | 5/1995 | Monk et al. | 324/73.1 |

*Primary Examiner*—Jack I. Berman

*Attorney, Agent, or Firm*—Terry J. Anderson; Karl J. Hoch, Jr.

[57] ABSTRACT

A Missile Launch and Flyout Simulator (MLFS) for simulating the UV and IR flight characteristics of an incoming missile throughout its launch, powered flight and post burnout phases, as would be viewed by a missile launch detection and tracking system. The simulator produces a UV output to simulate the launch of a missile, and an IR output to simulate the powered flight and post burnout phases of the missile's flight. In addition, the IR output ramps up in intensity during the simulated powered flight phase before dropping off to a simulated post burnout phase level, as would the IR signature of a real incoming missile. The simulator can also be programmable such that the duration of the emulated powered flight time, as well as the minimum and maximum IR intensity, can be varied to mimic the characteristics of the missile being simulated. In addition, the rate at which the IR intensity increases can be programmed so as to simulate different speeds of missile convergence to its target. The simulator is also portable and capable of being remotely triggered so that it can be used in isolated locations or on moving platforms.

39 Claims, 3 Drawing Sheets

MISSILE LAUNCH AND FLYOUT SIMULATOR

BACKGROUND

1. Technical Field

The present invention relates to simulators and, more particularly, to a Missile Launch and Flyout Simulator (MLFS) which mimics the ultraviolet (UV) emissions of a missile at launch and the changing infrared (IR) signature of the missile in flight.

2. Background Art

As is well known, various missile systems have been developed for ground-based and airborne launch applications. Coincident with the development of these missiles has been the development of various missile launch detection and tracking systems used to detect the launch and track the course of an incoming missile. Of particular interest in regards to the present invention are those systems which employ a wide quadrant sensor to detect a missile launch by sensing a UV radiation burst, thereafter switching to a fine tracker to track the missile via its IR signature. These types of missile launch detection and tracking systems are employed in a variety of applications. For example, one important application involving these systems is an electronic counter measure or missile jamming device. Such devices are typically used to detect the launch of a missile, track its course toward the target, and misdirect or otherwise disable the missile.

The proliferation of missile launch detection and tracking systems has created a need for simulators which emulate the flight of a missile. Without the use of a simulator, actual missiles (or flight-capable dummy versions thereof) would have to be launched in order to develop, test and train personnel in the use of the system. The associated costs, safety concerns, and in some cases the impracticality of actually launching a missile or dummy for the aforementioned tasks has dictated that missile simulators be employed in their stead.

In order for a missile simulator to effectively emulate an actual missile for the above-described launch detection and tracking systems, it must simulate the three general stages of a missile's flight, namely, the launch phase, the powered flight phase, and the post burnout phase. The launch phase consists of the ignition of the missile's rocket motor and its egress from its launch platform. This phase is marked by the production of a large plume which characteristically exhibits detectable amounts of UV radiation. The powered flight phase is that portion of the missile's flight in which its motor is active. This phase is characterized by a large IR signature resulting from the burning motor. In addition, during this phase the IR signature increases as the missile moves toward its target, which is typically near the missile launch detection and tracking system. Finally, the post-burn out phase is that portion of the missile's flight occurring after its motor has burned out or been shut down. This phase is characterized by a rapidly decreasing IR signature corresponding to the missile cooling down. The post burnout phase IR signature eventually stabilizes out at a small IR level primarily caused by air friction.

SUMMARY

The present invention is directed at a Missile Launch and Flyout Simulator (MLFS) for simulating the UV and IR flight characteristics of a missile throughout its launch, powered flight and post burnout phases. An intended objective of the present invention is to provide a simulator which produces a UV output to simulate the launch of a missile, and an IR output to simulate the powered flight and post burnout phases of the missile's flight. In addition, it is intended that the IR output ramp up in intensity during the simulated powered flight phase before dropping off to a simulated post burnout phase level. A further objective of the present invention is that the simulator be programmable such that the duration of the emulated powered flight time can be varied to match the missile being simulated. Another objective is that the maximum and minimum IR intensities be programmable to facilitate mimicking the characteristics of the missile's motor and its post burnout signature. It is also an objective of the invention that the rate at which the IR intensity increases be programmable so as to simulate different speeds of missile convergence to its target. And finally, it is an objective of the present invention that the simulator be portable and capable of being remotely triggered so that it can be used in isolated locations or on moving platforms.

Specifically, the foregoing objectives are obtained by an simulator apparatus having an emitter capable of producing the appropriate levels of UV and IR radiation in proportion to an amount of current flowing to the emitter. These emitted levels of UV and IR simulate the emissions of the incoming missile, as discussed above. The simulator also has a current source for controlling the amount of current flow to the emitter dependent upon a voltage level of a missile UV and IR profile signal input into the current source. The aforementioned signal is generated by the simulator, and includes a ramping portion having a substantially linearly increasing voltage level rising to a prescribed maximum voltage level over a prescribed time period and a constant portion which follows the ramping portion, and exhibits a prescribed minimum voltage level.

Preferably, the portion of the simulator which generates the missile UV and IR signal is capable of adjustably setting the prescribed minimum voltage level, the prescribed maximum voltage level, and the prescribed time period. In this way, a minimum IR signature of various missiles, which is exhibited during a post burnout phase of its flight, can be simulated by adjusting the minimum voltage level. Similarly, a maximum IR signature of various missiles, which is exhibited during a powered flight phase at a predetermined distance from the missile launch detection and tracking system, can be simulated by adjusting the maximum voltage level, and the powered flight phase duration associated with various missiles can be preset by adjusting the prescribed time period. Additionally, the current source is preferably adjustable so that the amount of current flow to the emitter can be either increased at the same rate as, increased more quickly than, or increased more slowly than, the voltage of the missile UV and IR profile signal. This allows the aforementioned speed of missile convergence to be simulated.

Further, it is preferred that a triggering device be included in the simulator which initiates the ramping portion of the missile UV and IR profile signal upon a command from a user at a remote location. This triggering device could be a simple switch located at the remote location which is activated by the user to initiate the ramping portion of the signal, or it could be a wireless receiver which activates the ramping portion in response to a wireless communication from the user. The simulator could also include both type of triggering devices, if desired.

The simulator can also include a self contained power source, thereby making it portable. This facilitates the use of apparatus at isolated locations as will often be required when evaluating a missile launch detection and tracking system. Specifically, the self contained power source might employ batteries.

The simulator operates by emitting UV radiation at a level exceeding a launch detection threshold of the missile launch detection and tracking system whenever the current flowing to the emitter depends upon a launch voltage level exhibited by the ramping portion of the missile UV and IR profile signal. This simulates the launch of the missile. In addition, increasing IR radiation levels are emitted, which are proportional to a rise in current flow, and which are in turn dependent on the rise in voltage of the ramping portion of the missile UV and IR profile signal. These increasing IR radiation levels, after the launch voltage level is exceeded, simulate the increasing IR signature of the incoming missile during its powered flight phase. The simulator also emits IR radiation at a level simulating a minimum IR signature associated with a post burnout phase of the missile whenever the current flowing to the emitter depends solely on the constant portion of the missile UV and IR profile signal. However, this minimum post burnout emission level is preferably preceded by the emitting of gradually decreasing IR radiation to simulate a cooling phase of a missile following an end of its powered flight phase. This cooling phase would be simulated whenever the current flowing to the emitter depends on a portion of the missile UV and IR profile signal corresponding to the transition from the maximum voltage level of the ramping portion of the signal to the minimum voltage level of the constant portion of the signal.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

Figure 1:
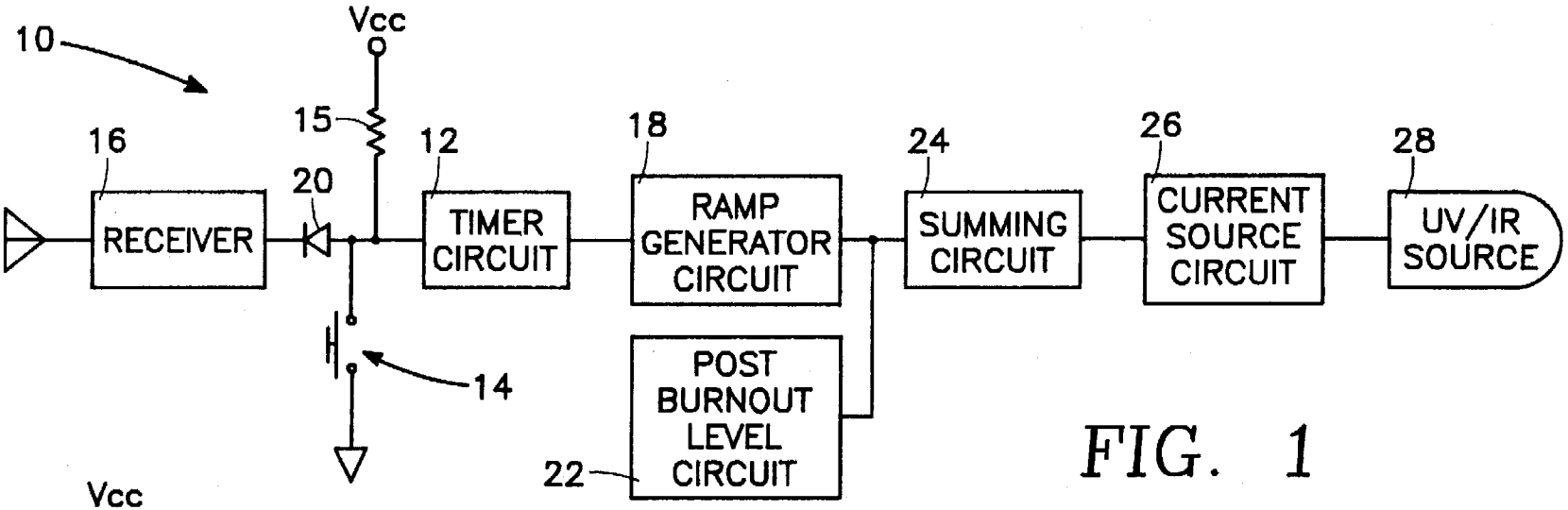
FIG. 1 is a block diagram of a missile launch and flyout simulator in accordance with the present invention.

FIG. 1 depicts, in simplified block diagram form, the basic elements which make up the preferred embodiment of a Missile Launch and Flyout Simulator (MLFS) in accordance with the present invention. The depicted simulator 10 includes a timer 12 which is used to control the simulation of the launch and powered flight phases of the missile. The timer 12 generates a signal whose duration is preferably adjustable. The initiation of the timer signal is used to simulate the launch of a missile, and the duration of the signal is used to simulate the period of time that the missile's motor is active or burning (as will be discussed later). By adjusting the duration of the timer signal, various missiles having different powered flight times can be simulated.

Although the timer 12 could be triggered in many different ways, it is preferred that the triggering be accomplished by a negative going edge in a signal fed into the timer 12. One version of this preferred embodiment of the simulator 10 employs a switch 14 to create the aforementioned negative going edge. As can be seen in FIG. 1, when the switch 14 is activated, the voltage signal ($V_{cc}$) feed into the timer 12 is pulled down, thus creating a negative going edge in the signal. The resistor 15 is chosen to ensure a clearly defined negative going edge is created in the signal, i.e. one well within the selected low logic level range for the circuit. Negative edge triggering is preferred because it is desirable to initiate the simulator 10 remotely, for example, from up to 1000 feet away. It is much more reliable to momentarily pull down the voltage of a signal fed into the timer 12 via a resident voltage source, than it would be to attempt to create a high logic level or positive going edge with a remote power supply. The voltage drop that would occur in the lines connecting a remote power supply to the simulator 10, as well as noise that could be introduced in the circuit, would make the latter scenario much less reliable.

The simulator 10 can also include an receiver 16 that generates the necessary negative going edge upon receipt of a remotely sent command from a user. Receivers capable of performing this task are well known and so will not be described in detail herein. The receiver 16 can be included in addition to the aforementioned switch 14, or in lieu of it. If both a receiver 16 and switch 14 are employed (as shown in FIG. 1), a diode 20 is used to isolate the receiver 16 from the voltage source signal to prevent any interference. This dual activation scheme allows the timer 12 to be triggered by either the switch 14 or the receiver 16, whichever is preferred.

Figure 2:
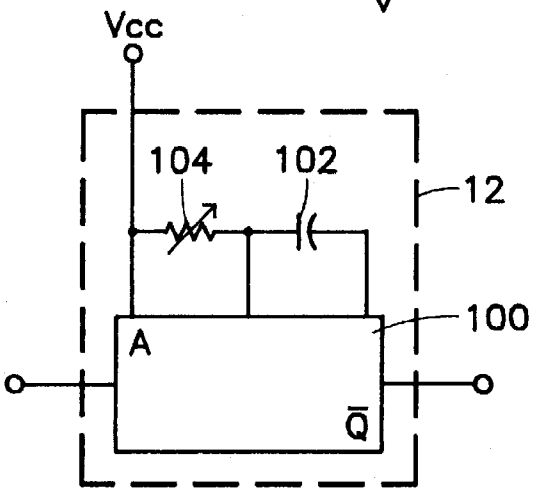
FIG. 2 preferred circuitry for the timer circuit block of FIG. 1.

A preferred circuit implementation of the timer 12 is shown in FIG. 2. A 54C221 monostable vibrator 100 is employed. This monostable 100 is triggered by a negative going edge in the signal from the aforementioned receiver or momentary switch fed into the "A" port. A fixed capacitor 102 and variable resistor 104 are also connected to the monostable 100 in such a way as to preset the count duration, and so the duration of a low logic level signal output from the "Qbar" port. The signal output from the "Qbar" port has a high logic level voltage before the monostable 100 is triggered, and a low logic level voltage after triggering. The aforementioned capacitor 102 and variable resistor 104 are chosen so as to produce the low logic level signal output for a desired range of duration times. The resistance of the variable resistor 104 is varied to adjust the signal duration to a specific period of time required for the particular missile being simulated (e.g. on the order of 10 seconds for some missile simulations).

Figure 6:
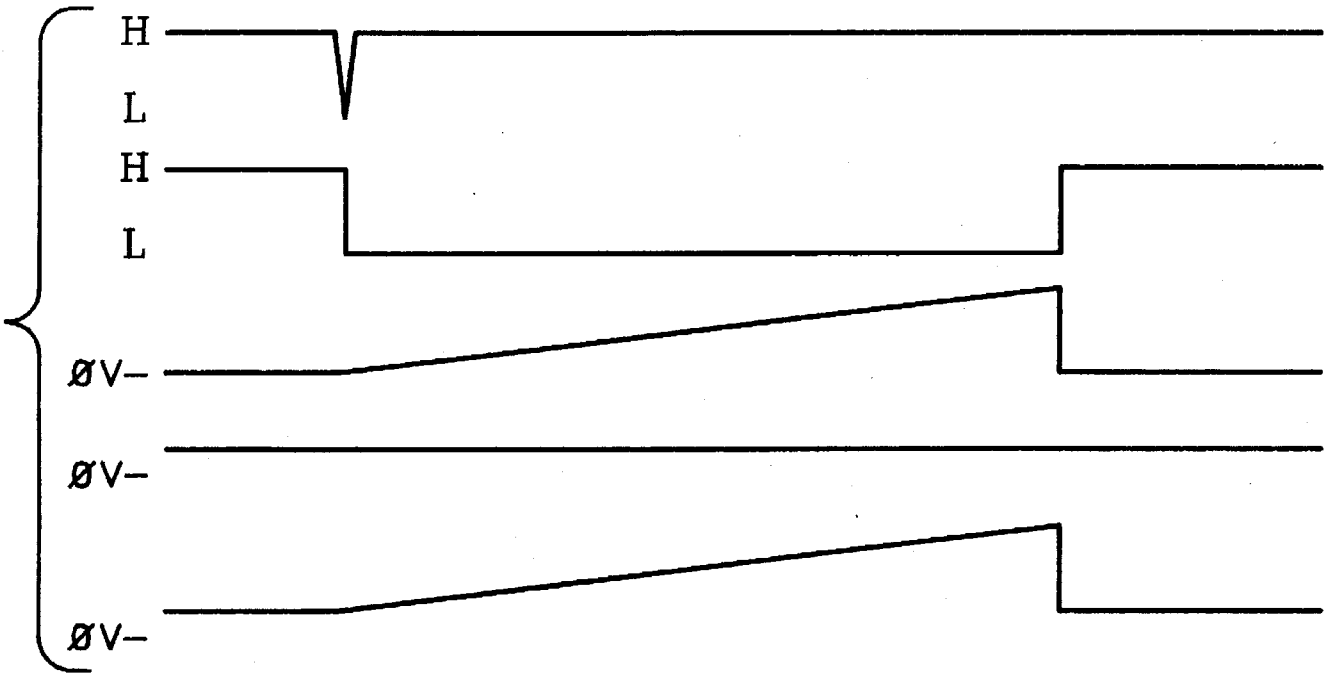
FIG. 6 is a timing diagram showing voltage over time for the various signals produced by the circuitry of FIGS. 2–4.

The aforementioned triggering and timing signals are depicted in the first and second lines of the timing diagram provided in FIG. 6. As can be seen the negative going edge of the triggering signal causes the timing signal to go low for a preset period of time.

The timer signal, once initiated, is fed into a programmable ramp generator circuit 18, as shown in FIG. 1. This circuit 18 produces a signal for the duration of the timer signal which progressively increases in voltage to a prescribed maximum. When the timer signal is terminated, the signal from the ramp circuit 18 terminates, as well. As will be discussed in more detail later, the just-described ramping signal is used to produce an IR output from the simulator 10 which emulates the IR profile of an incoming missile during its powered flight phase. The increasing voltage represents the increasing IR signature of the missile as it gets closer to the launch detection and tracking system, and the maximum voltage corresponds to the maximum IR radiation expected to be seen by the system at an predetermined minimum distance for the missile being emulated. For example, in the case where the missile launch and flight path is being monitored by a missile jamming system, this expected maximum would typically correspond to a missile passing no closer than 1 or 2 kilometers from launch detection and tracking device. The aforementioned prescribed maximum voltage level output by the ramp circuit 18 is preferably adjustable. This enables, the ramp circuit 18 to generate a signal which can ultimately produce a maximum IR emanation from the simulator 10 which corresponds to a variety of missiles with different maximum IR signatures.

The next component of the simulator 10 to be discussed, with reference to FIG. 1, is the post burnout level circuit 22. This circuit 22 supplies a DC signal having a constant voltage level, and performs several functions. First, the signal is used to produce an IR output from the simulator 10 which simulates the minimum IR signature of a missile after the motor has burned out or shut down. The aforementioned constant voltage level is preferably adjustable so as to emulate the post burnout IR levels of a variety of missiles. In order to accomplish the aforementioned task, the signal from the post burnout level circuit 22 is summed with the ramping signal from the ramp circuit 18, via a summing circuit 24. Accordingly, during the time the ramping signal is being produced, the post burnout level signal is added to it, thereby producing a pedestal voltage level from which the ramping voltage builds. Since this pedestal voltage exists, although typically quite small in comparison to the ramping signal (e.g. one-tenth or less), part of the IR radiation ultimately produced by the simulator 10 during the simulated powered flight phase will be associated with it. If necessary, the maximum ramp signal voltage should be chosen to take this pedestal voltage into account. After the timer signal terminates, thus terminating the ramping signal, only the post burnout level signal will remain, thus the output of the summing circuit 24 will solely reflect this post burnout signal level. As mentioned above, the IR output from the simulator 10 when only the post burnout level signal is present simulates the minimum IR signature expected from a missile after its motor has burned out or been shut down. It is noted that the post burnout IR signature of a missile is relatively small and typically occurs when the missile is at its closest point to the missile launch detection and tracking system. It has been found that there is no need to vary the IR output of the simulator 10 at this stage because the IR signature of a missile, as viewed from the system, does not change significantly. It is also noted that the post burnout level circuit preferably produces a signal whenever the simulator is powered. Thus, not only is the signal generated during the simulated launch, powered flight and post burnout phases of the missile, but also prior to the launch phase (i.e. the initiation of the timer signal). The post burnout signal prior to the initiation of the timer 12 is used to warm up the UV/IR source 28, as will be discussed in more detail in conjunction with a description of this source.

Figure 3:
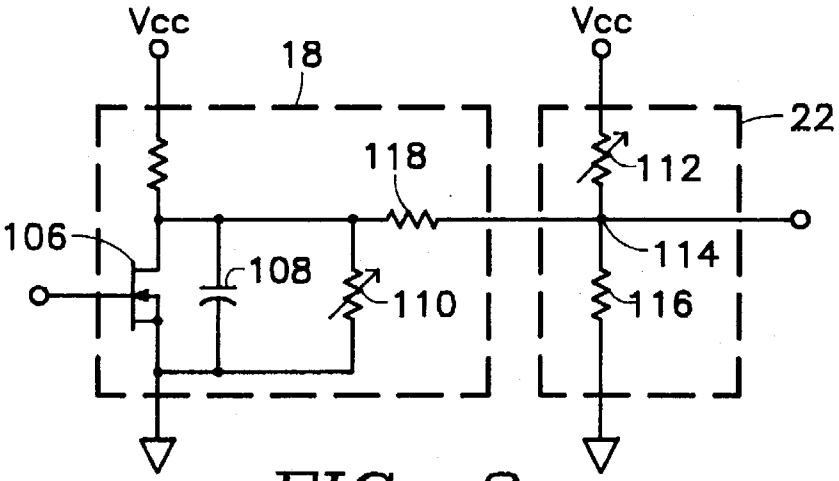
FIG. 3 shows preferred circuitry for the ramp generator and post burnout level circuit blocks of FIG. 1.

FIG. 3 illustrates a preferred implementation of the ramp generator circuit 18 and the post burnout level circuit 22. The output from the timer is fed into the gate of an enhancement mode MOSFET switch 106 (e.g. IRFF110). The drain of the switch 106 is tied to the simulator's voltage source ($V_{cc}$) through an appropriate resistor and a RC circuit having a fixed capacitor 108 in parallel with a variable resistor 110. The source of the switch 106 is tied to the other side of the RC circuit and to the simulator ground. This portion of the circuit corresponds to the aforementioned ramp generator 18. During the time that the timer signal is high, the MOSFET 106 is active and the RC circuit is discharged. However, when the timer is triggered and the timer signal goes low, the MOSFET 106 is deactivated and the capacitor 108 of the RC circuit is allowed to charge. This produces a ramping signal at the output of the RC circuit. The variable resistor 110 is adjusted to set the desired maximum voltage of the ramping signal by varying the resistance until the desired maximum voltage is reached just at the end of the timer's low voltage signal period. It is noted that the capacitor 108 and variable resistor 110 values should be chosen so that the desired maximum occurs in the linear portion of the voltage ramp created by the RC circuit. This ensures a predictable approximation of a linear response. The preferred post burnout level circuit 22 has a variable resistor 112 connected on one side to the simulator's voltage source ($V_{cc}$) and on the other side to an output node 114 which is also connected to a fixed resistor 116. The side of the fixed resistor 116 opposite the output node 114 is connected to simulator ground. The variable resistor 112 and fixed resistor 116 are chosen so as to produced the a signal having the desired range of post burnout level voltages at the output node 114. The variable resistor 112 would be adjusted to produce the specific voltage level which will ultimately produce the particular minimum post burnout IR signature of the missile being simulated. The output of the ramp generator circuit 18 is also connected to the output node 114 of the post burnout level circuit 22 through an appropriate resistor 118.

Figure 4:
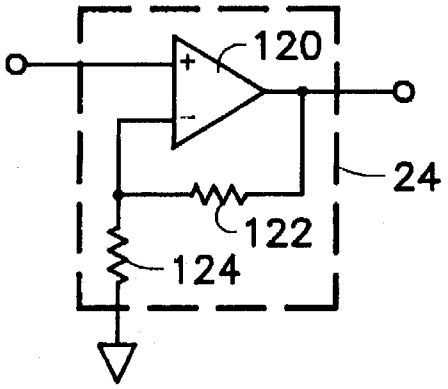
FIG. 4 shows preferred circuitry for the summing circuit block of FIG. 1.

The preferred implementation of the summing circuit 24 is shown in FIG. 4. It consists of a summing amplifier 120 having its non-inverting input connected to the output node 114 of the post burnout level circuit 22 (of FIG. 3) and an appropriate feedback circuit connected to the inverting input. This configuration not only sums the signals from the ramp generator circuit 18 and post burnout level circuit 22, but also acts as a buffer. The feedback resistors 122, 124 are chosen to provide a gain of unity.

The above-described ramp generator, post burnout level, and summing circuit output signals are illustrated as the third, fourth and fifth lines, respectively, in the timing diagram of FIG. 6. As can be seen, the ramping signal starts increasing in voltage from 0 volts to the desired maximum (e.g. 10 volts) at the beginning of the low voltage period of the timing signal and returns to 0 volts at the end of this low voltage period. The post burnout level signal (shown in the fourth line) remains at a constant voltage just above 0 volts (e.g. 1 volt) for the entire time the simulator is powered. When combined in the summing circuit, the resulting signal (shown in the fifth line) starts out at the low voltage level associated with the post burnout level signal, ramps up from this low voltage level to a maximum during the "low" timing signal period, and then drops back down to the lower voltage level for the remaining portion of the timing sequence.

Referring once again to FIG. 1, it can be seen that the signal output from the summing circuit 24 is input into a voltage controlled current source circuit 26. The purpose of the current source circuit 26 is to produce a current flow through the aforementioned UV/IR source 28, where the amount of current is at least partially controlled by the voltage of the signal output from the summing circuit 24. Accordingly, when the simulator 10 is powered, the current through the UV/IR source 28 will either track the constant post burnout level signal voltage, or the ramping combined voltage associated with the post burnout level signal and the ramp generator signal. In addition, the current source 26 is preferably adjustable so as to vary the rate at which the current through the UV/IR source 28 is increased in response to the increasing voltage of the ramping signal during the simulated launch and powered flight phases of a missile. Thus, even though the rise time of the voltage associated with the signal produced by the ramp generator circuit 18 is always the same, the rise time of the current through the UV/IR source 28 can be adjusted. By adjusting the rise time of the current through the UV/IR source 28, the simulated speed of convergence of a missile can be varied. For example, the rise time would be decreased, thereby increasing the rate at which the current through the UV/IR source 28 increases, to simulate a missile converging more quickly towards the launch detection and tracking device. This results because the amount of IR radiation produced by the UV/IR source 28 increases as the current through it increases. Conversely, the simulated speed of missile convergence can be made slower by increasing the rise time of the current through the UV/IR source 28. In this way, a variety of missiles with different characteristic velocities, or a particular missile being launched at varying distances from the launch detection and tracking system, can be simulated.

Figure 5:
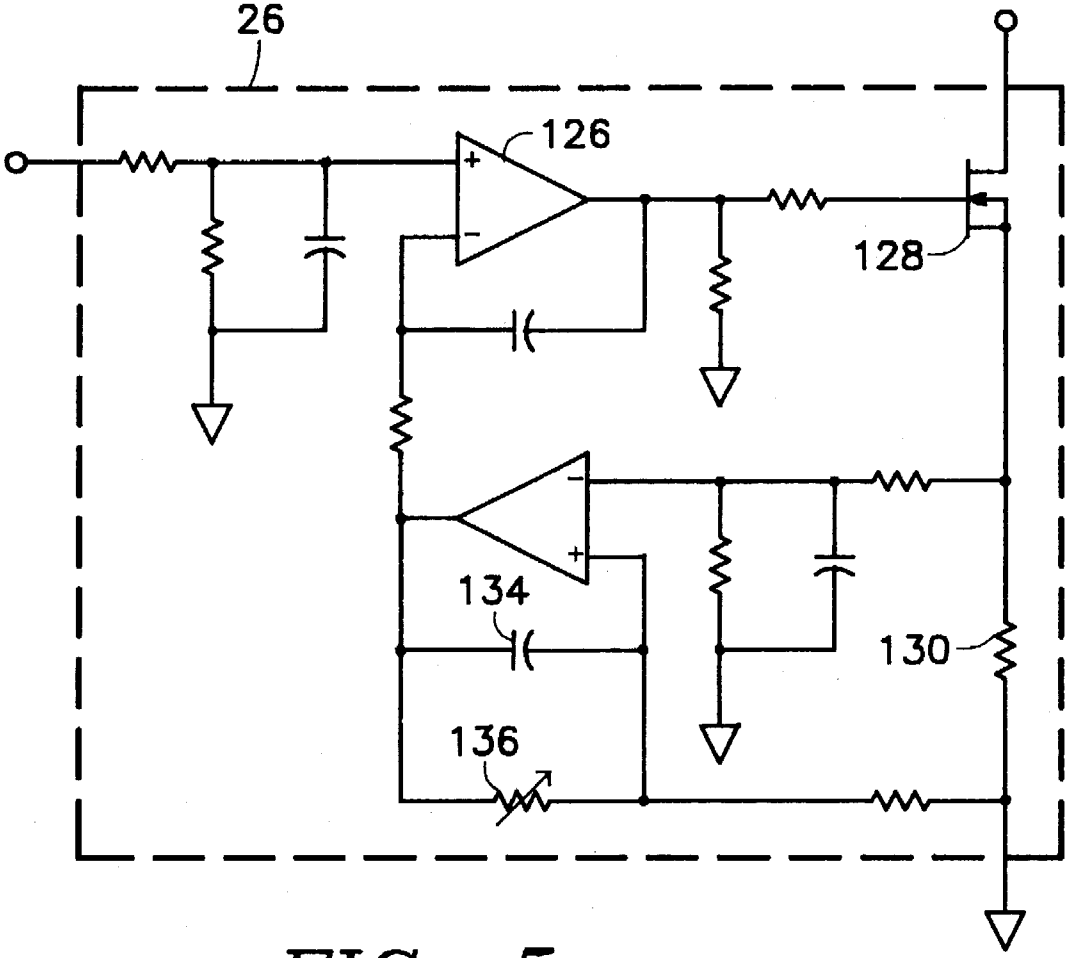
FIG. 5 shows preferred circuitry for the current source circuit block of FIG. 1.

The preferred implementation of the current source 26 is shown in FIG. 5. Essentially, this preferred circuit includes an error amplifier 126 having its non-inverting input tied to the output of the summing circuit 24 and its output tied to the gate of an enhancement mode MOSFET 128 (e.g. IRF150). The drain of the MOSFET 128 is connected through the UV/IR source 28 to the simulator's voltage source ($V_{cc}$). The source of the MOSFET 128 is connected to simulator ground through a resistor 130. The non-inverting input to a variable gain differential amplifier 132 is connected between the MOSFET 128 and the resistor 130, while the inverting input of the amplifier 132 is connected between the resistor 130 and ground. The gain of the amplifier 132 is made variable via a RC feedback circuit consisting of a fixed capacitor 134 and a variable resistor 136. The gain is adjusted by varying the resistance of the variable resistor 136. The output of the variable gain differential amplifier 132 is connected to the inverting input of the aforementioned error amplifier 126. In addition to the above-described elements, various resistors of appropriate resistances are employed in the circuit between the major elements for bias matching purposes. Also, a RC circuit having an appropriate RC time constant is incorporated at the non-inverting inputs to the amplifiers 126, 132 to filter out any high frequency noise that may be introduced into the circuit from outside sources, such as by radio frequency (RF) signals in the vicinity. The capacitor providing feedback to the inverting input of the error amplifier 126 is included for the same reason.

The voltage of the signal output from the error amplifier 126 is used to control the amount of current that is allowed to flow through the UV/IR source 28, and so, the amount of UV and IR emitted from the source 28. The higher the voltage, the more current that is allowed to flow, up to the point where the MOSFET 128 is fully saturated. At that point the current flow becomes maximum. The output of the error amplifier 126 will attempt to drive the output of the differential amplifier 132 to match that of the summed signal (i.e. the error amplifier will attempt to eliminate any difference in voltage between its inputs). In other words, the output of the error amplifier 126 will have sufficient voltage to create a current flow through the resistor 130 so that the difference in voltage between the inputs to the differential amplifier 132, times its gain, will produce an output which equals the voltage of the summed signal. Thus, when the summed signal corresponds to the constant post burnout signal, the output form the error amplifier 126 will be constant, thereby producing a constant current flow through the UV/IR source 28. This current flow will produce an IR level which equates to the minimum IR signature of the missile being simulated (as set by the voltage of the post burnout level circuit signal). However, when the summed signal includes the ramping signal from the ramp generator circuit 18, the output from the differential amplifier 132 will always lag behind the summed signal, and the error amplifier 126 will continuously increase its output voltage in an attempt to equalize the difference. Accordingly, the current through the UV/IR source 28 will also continuously increase.

It can also be seen that by adjusting the gain of the differential amplifier 132, the current level required to drive its output to match the summed signal will also change. The capacitor 134, variable resistor 136, and resistor 130 are preferably chosen so that a desired range of possible gain values can be achieved. In addition, it is preferred that at a predetermined point in the resistance range of the variable resistor 136, the rate of voltage increase in the error amplifier output matches the rate of increase in the ramping summed signal. For example, the capacitor 134, variable resistor 136, and resistor 130 could be chosen such that a 10 to 1 increase or decrease in gain can be achieved by adjusting the variable resistor 136. In this example, a gain of one (1) could represent the balance point, and the gain could be increased to ten (10), or decreased to one-tenth (1/10). When the gain is increased above the balance point, it takes less of an increase in voltage to drive the differential amplifier's output to match that of the summed signal. Conversely, when the gain of the differential amplifier 132 is decreased below the aforementioned balance point, it will take more of an increase in the voltage of the error amplifier's output to equalize the error amplifier's input signals. Because of the above-described relationship, if the gain is increase above the balance point, the current flow will increase at a rate slower than the voltage of the summed signal and if the gain is decreased below the balance point, the current flow will increase at a faster rate than the voltage of the summed signal. Thus, by adjusting the gain of the differential amplifier 132, the apparent speed of missile convergence can be varied to match the particular missile being simulated because the faster the current rises, the faster the apparent convergence.

Figure 7:
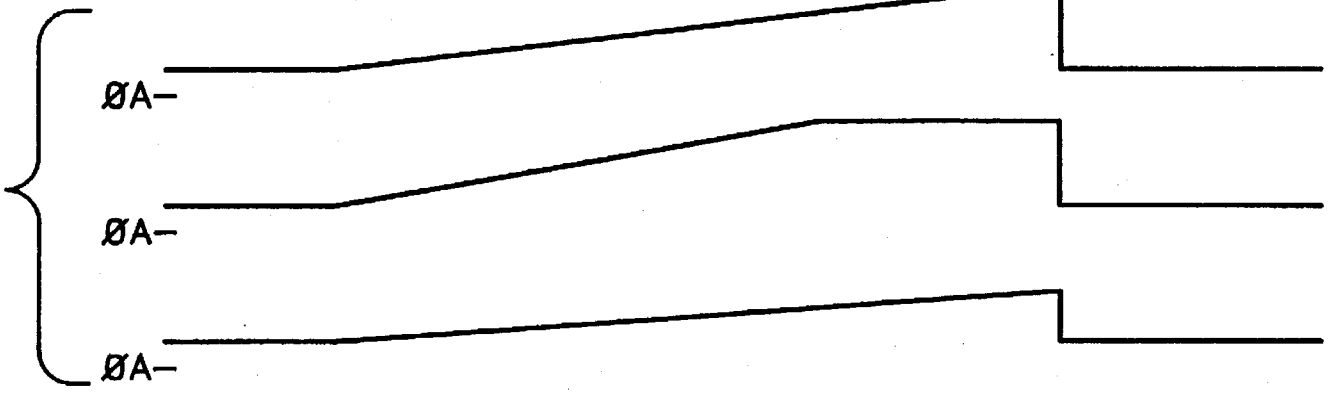
FIG. 7 is a diagram plotting current over time through the UV/IR source of FIG. 1, as controlled by the circuitry of FIG. 5 for three different gain conditions.

The first line in FIG. 7 depicts the current flow produced by the current source 26 where the gain of the adjustable amplifier 132 has been set to cause a nominal current rise. Specifically, the nominal current rise is one which closely matches the increase of voltage in the ramping summed signal. As can be seen, the current rises from a low level, associated with the post burnout level signal, to a maximum at the end of the "low" timer signal period, and then falls back down. The MOSFET 128 is preferably chosen so that at this nominal current rate, it is fully activated only at the current level which causes an IR output consistent with the aforementioned maximum expected at the end of the simulated powered flight phase of the missile (as set by the ramp generator signal). The second line in FIG. 7 depicts the current flow produced by the current source 26 where the gain of the adjustable amplifier 132 has been set to cause a relatively quick current rise (thereby simulating a fast converging missile). As can be seen, the current rises from a low level, associated with the post burnout level signal, to a maximum about three-quarters of the way through the "low" timer signal period. Thereafter, the MOSFET 128 is fully saturated and the current level remains at the maximum value until the end of the timer signal period, at which time it drops back to the original low current level. This second current profile mimics a high velocity missile, or one which is launched relatively close to the launch detector and tracking system, and which reaches the target before the end of its powered flight time. The third line in FIG. 7 shows the current flow produced by the current source 26 where the gain of the adjustable amplifier 132 has been set to cause a relatively slow current rise. Specifically, a current rise slower than the increase of voltage in the ramping summed signal. As can be seen, the current rises from a low level, associated with the post burnout level signal, to a maximum at the end of the "low" timer signal period, and then falls back down. In this case, the MOSFET 128 is never fully activated. In addition, the maximum current flow is below that which would have produce the maximum expected IR signature of the simulated missile. This third current profile mimics a low velocity missile, or one which is launched from a relatively long distance from the launch detector and tracking system, and one whose motor burned out prior to reaching the distance from the system where a maximum IR signature would have been seen. These three current profiles exemplify the three gain conditions of the differential amplifier, i.e. where the gain is such that the current rises at the same rate as the voltage of the summed signal, where the gain is such that the current rises faster than the voltage of the summed signal, and where the gain is set so that the current rises slower than the voltage of the summed signal.

It should also be noted that adjusting the gain of the amplifier 132 to increase or decrease the current rise time will also effect the current levels during the pre-launch and post burnout phases of the missile simulation. Accordingly, this effect must be taken into consideration when setting the post burnout level circuit 22. The post burnout level circuit 22 must be adjusted so that its signal voltage results in the desired current flow (and so the desired UV and IR outputs) for the particular preset gain of the amplifier 132 in the current source 26.

As alluded to above, the UV/IR source 28 shown in FIG. 1 produces increasing levels of both UV and IR radiation, as the current through the source 28 increases. Thus, the output from the UV/IR source 28 is controlled by the current source 26. Further, the UV/IR source 28 is chosen so that the current flow allowed by the current source 26 in response to the presence of only the constant post burnout level circuit signal voltage, produces a UV radiation output level below that necessary to trigger the launch sensor of the missile launch detection and tracking system being employed. It is noted that the IR radiation from the source 28 is irrelevant at this point in the simulation since the aforementioned system will not begin tracking IR emissions until after a launch is detected. Only once the timer 12 is activated and the resulting ramp generator circuit signal causes the current source 26 to increase the current flow through the UV/IR source 28, does the UV radiation from the UV/IR source 28 exceed the missile launch detection and tracking system's UV launch threshold. Thereafter, the system's IR tracking device is activated and the increasing IR output from the source 28 detected, thereby simulating the powered flight phase of the missile. At this point, the UV output from the source 28 becomes irrelevant. Finally, when the timer signal is terminated, the current through the UV/IR source 28 drops back down to track the post burnout level. The UV/IR source 28 is also chosen so that the same current level initially producing a UV radiation level below the employed missile launch detection and tracking system's launch threshold, now produces IR levels which approximately mimic the minimum post burnout phase IR signature of the missile being simulated.

It has been found that commercially available halogen lamps used in automobile headlights (e.g. H4) will produce the above-described levels of UV and IR emissions, i.e. UV emissions at a particular current level which are below the launch detection threshold of many known missile launch detection and tracking systems, but which also produces IR levels at this same current level that emulate the minimum post burnout IR signature of a variety of known missile types. An additional advantage of using these halogen lamps is that once the ramping signal from the ramp generator circuit 18 is terminated, thereby dropping the current flow through the lamp to the level corresponding to the post burnout signal, the lamp goes through a cooling phase where the IR emissions gradually decrease to the desired minimum value. This cooling phase mimics the IR signature of a missile once its motor is burned out or shut down. Finally, it has been found that these same halogen lamps will produce sufficient IR emissions at higher currents to accurately mimic the powered flight phase IR signatures of many different missiles.

It is noted that the reason behind the aforementioned preference that a low level current flow through the UV/IR source 28 prior to the initiation of the timer 12 is to "warm up" the source 28. It has been found that a significant delay between timer activation and the production of sufficient UV to simulate missile launch can occur when using the aforementioned halogen lamps. However, if such a lamp has a low level "warming" current flowing through it, this delay is reduced significantly. It is further noted that the UV/IR source 28 is preferably chosen so that it produces the necessary IR levels at the aforementioned post burnout level current to accurately mimic the minimum post burnout IR signature of the missile being simulated, while also producing UV levels as close to the triggering threshold of the missile launch detection and tracking system as possible. This preferred UV/IR source selection will preclude any significant portion of the ramping signal from the ramp generator circuit 18 having to be used to initiate the simulated launch, thus causing an unnecessary delay between the initiation of the timer 12 and the launch detection by the system.

The exact UV and IR levels that the simulator 10 is capable of producing depend not only on the chosen UV/IR source, but also on the simulator voltage source ($V_{cc}$). It has been found that the preferred halogen lamps can produce UV and IR levels sufficient to simulate the launch and flight characteristics of various known missiles using a voltage supply capable of producing voltages in the range of 7 to 15 volts. Voltages in this range can be supplied by a DC power supply, however, employing batteries is also an option. The battery option has the advantage of making the simulator 10 more portable so that it can be readily used at remote sites without any necessity of being connected to a power cable. Using the battery option also makes it easier to mount the simulator 10 to moving objects, such as a ground vehicle or rotating arm, should this be required to more accurately simulate the incoming missile.

While the invention has been described in detail by reference to the preferred embodiment described above, it is understood that variations and modifications thereof may be made without departing from the true spirit and scope of the invention.

Wherefore, what is claimed is:

1. An apparatus for simulating ultraviolet (UV) and infrared (IR) emissions of an incoming missile as sensed by a missile launch detection and tracking system, the apparatus comprising:

an emitter capable of producing levels of UV and IR radiation in proportion to an amount of current flowing to the emitter, wherein the emitted levels of UV and IR simulate the emissions of the incoming missile;

current source means for controlling the amount of current flow to the emitter dependent upon a voltage level of a missile UV and IR profile signal input into the current source means; and, means for generating the missile UV and IR profile signal, said signal comprising, a ramping portion having a substantially linearly increasing voltage level rising to a prescribed maximum voltage level over a prescribed time period, and a constant portion following the ramping portion and exhibiting a prescribed minimum voltage level.

2. The apparatus of claim 1, wherein the generating means comprises:

means for adjustably setting the prescribed minimum voltage level;

means for adjustably setting the prescribed maximum voltage level; and, means for adjustably setting the prescribed time period.

3. The apparatus of claim 1, wherein the generating means comprises means for initiating the ramping portion of the missile UV and IR profile signal upon a command from a user of the simulating apparatus.

4. The apparatus of claim 1, wherein the current source means comprises means for adjustably setting the amount of current flow to the emitter such that the current flow one of (i) increases at the same rate as, (ii) increases more quickly than, or (iii) increases more slowly than, the voltage of the missile UV and IR profile signal.

5. The apparatus of claim 1, wherein the generator means comprises:

ramp generator means for generating the ramping portion of the missile UV and IR profile signal in response to an inputted timing signal, wherein the ramping portion rises from a minimum voltage level at a beginning of the timing signal to the prescribed maximum at the end of the timing signal;

post burnout level means for generating the constant portion of the missile UV and IR profile signal; and, summing means for combining the ramping portion and constant portion of the missile UV and IR profile signal such that the voltages thereof are summed, and for inputting the signal to the current source means.

6. The apparatus of claim 5, further comprising timing means for providing the timing signal to the ramp generator means, said timing signal having a prescribed duration controlled by the timing means.

7. The apparatus of claim 6, further comprising triggering means for initiating the inputting of the timing signal from the timing means to the ramp generator means upon a command from a user of the simulating apparatus.

8. The apparatus of claim 3, wherein the initiating means comprises means for receiving said user command from a remote location.

9. The apparatus of claim 8, wherein:

the receiving means comprises a switch located at said remote location; and, said user command comprises actuating the switch.

10. The apparatus of claim 9, wherein the switch, whenever activated, causes a negative going edge in a signal supplied to the initiating means from a voltage supply resident in the simulating apparatus, said negative going edge causing the initiating means to initiate the ramping portion of the missile UV and IR profile signal.

11. The apparatus of claim 8, wherein:

the receiving means comprises a wireless receiver; and, the user command comprises a wireless communication with said receiver.

12. The apparatus of claim 11 wherein the wireless receiver causes a negative going edge in a signal supplied to the initiating means by the receiver in response to the wireless communication, said negative going edge causing the initiating means to initiate the ramping portion of the missile UV and IR profile signal.

13. The apparatus of claim 9, wherein:

the receiving means further comprises, a wireless receiver, and means for electrically isolating the receiver from the switch; and, the user command additionally comprises a wireless communication with said receiver.

14. The apparatus of claim 1, further comprising a self contained power source resident in the simulating apparatus, thereby making the apparatus portable.

15. The apparatus of claim 14, wherein the power source comprises batteries.

16. The apparatus of claim 1, wherein the emitter is capable of emitting UV radiation at a level exceeding a launch detection threshold of the missile launch detection and tracking system whenever the current flowing to the emitter depends upon a launch voltage level exhibited by the ramping portion of the missile UV and IR profile signal.

17. The apparatus of claim 16, wherein the emitter is further capable of emitting increasing IR radiation levels proportional to a rise in current flow dependent on the rise in voltage of the ramping portion of the missile UV and IR profile signal, said increasing IR radiation levels, after the launch voltage level is exceeded, simulating an increasing IR signature of the incoming missile during a powered flight phase.

18. The apparatus of claim 1, wherein the emitter is capable of emitting IR radiation at a level simulating a minimum IR signature associated with a post burnout phase of the missile whenever the current flowing to the emitter depends solely on the constant portion of the missile UV and IR profile signal.

19. The apparatus of claim 1, wherein the emitter is capable of emitting gradually decreasing IR radiation simulating a cooling phase of a missile following an end of a powered flight phase whenever the current flowing to the emitter depends on a portion of the missile UV and IR profile signal corresponding to the transitions from the maximum voltage level of the ramping portion of the signal to the minimum voltage level of the constant portion of the signal.

20. The apparatus of claim 1, wherein the missile UV and IR profile signal generated by the generating means further comprises a pre-launch portion preceding the ramping portion of the signal for placing the emitter in a state of readiness.

21. The apparatus of claim 20, wherein the prelaunch portion of the missile UV and IR profile signal exhibits the prescribed minimum voltage level.

22. The apparatus of claim 21, wherein the emitter is further capable of emitting UV radiation at a level below a launch detection threshold of the missile launch detection and tracking system whenever the current flowing to the emitter depends solely on the prescribed minimum voltage level of the pre-launch portion of the missile UV and IR profile signal.

23. The apparatus of claim 22, wherein the emitter is further capable of emitting UV radiation at a level exceeding the launch detection threshold of the missile launch detection and tracking system whenever the current flowing to the emitter depends on a launch voltage level exhibited by the ramping portion of the missile UV and IF profile signal.

24. The apparatus of claim 23, wherein the launch voltage level is greater than, but not substantially exceeding, the prescribed minimum voltage level whenever the emitter is in said state of readiness.

25. The apparatus of claim 1, wherein the emitter is a halogen lamp.

26. A method for simulating ultraviolet (UV) and infrared (IR) emissions of an incoming missile as sensed by a missile launch detection and tracking system, the method comprising the steps of:

emitting levels of UV and IR radiation in proportion to an amount of current flowing to an emitter, wherein the emitted levels of UV and IR simulate the emissions of the incoming missile;

controlling the amount of current flow to the emitter dependent upon a voltage level of a missile UV and IR profile signal; and, generating the missile UV and IR profile signal, said signal comprising, a ramping portion having a substantially linearly increasing voltage level rising to a prescribed maximum voltage level over a prescribed time period, and a constant portion following the ramping portion and exhibiting a prescribed minimum voltage level.

27. The method of claim 26, wherein the generating step comprises:

adjustably setting the prescribed minimum voltage level to simulate a minimum IR signature of the missile exhibited during a post burnout phase;

adjustably setting the prescribed maximum voltage level to simulate a maximum IR signature of the missile exhibited during a powered flight phase at a predetermined distance from the missile launch detection and tracking system; and, adjustably setting the prescribed time period to specify a powered flight phase duration associated with the missile.

28. The method of claim 26, wherein the generating step comprises initiating the ramping portion of the missile UV and IR profile signal upon a command from a user.

29. The method of claim 26, wherein the controlling step comprises adjustably setting the amount of current flow to the emitter such that the current flow one of (i) increases at the same rate as, (ii) increases more quickly than, or (iii) increases more slowly than, the voltage of the missile UV and IR profile signal.

30. The method of claim 28, wherein the initiating step comprises receiving said user command from a remote location.

31. The method of claim 26, wherein the emitting step comprises emitting UV radiation at a level exceeding a launch detection threshold of the missile launch detection and tracking system whenever the current flowing to the emitter depends upon a launch voltage level exhibited by the ramping portion of the missile UV and IR profile signal.

32. The method of claim 31, wherein the emitting step further comprises emitting increasing IR radiation levels proportional to a rise in current flow dependent on the rise in voltage of the ramping portion of the missile UV and IR profile signal, said increasing IR radiation levels, after the launch voltage level is exceeded, simulating an increasing IR signature of the incoming missile during a powered flight phase.

33. The method of claim 26, wherein the emitting step comprises emitting IR radiation at a level simulating a minimum IR signature associated with a post burnout phase of the missile whenever the current flowing to the emitter depends solely on the constant portion of the missile UV and IR profile signal.

34. The method of claim 26, wherein the emitting step comprises emitting gradually decreasing IR radiation simulating a cooling phase of a missile following an end of a powered flight phase whenever the current flowing to the emitter depends on a portion of the missile UV and IR profile signal corresponding to the transitions from the maximum voltage level of the ramping portion of the signal to the minimum voltage level of the constant portion of the signal.

35. The method of claim 26, wherein the missile UV and IR profile signal further comprises a pre-launch portion preceding the ramping portion of the signal for placing the emitter in a state of readiness.

36. The method of claim 35, wherein the prelaunch portion of the missile UV and IR profile signal exhibits the prescribed minimum voltage level.

37. The method of claim 36, wherein the emitting step comprises emitting UV radiation at a level below a launch detection threshold of the missile launch detection and tracking system whenever the current flowing to the emitter depends solely on the prescribed minimum voltage level of the pre-launch portion of the missile UV and IR profile signal.

38. The method of claim 37, wherein the emitting step further comprises emitting UV radiation at a level exceeding the launch detection threshold of the missile launch detection and tracking system whenever the current flowing to the emitter depends on a launch voltage level exhibited by the ramping portion of the missile UV and IF profile signal.

39. The method of claim 38, wherein the launch voltage level is greater than, but not substantially exceeding the prescribed minimum voltage level whenever the emitter is in said state of readiness.

* * * * *